US007316144B2

(12) United States Patent
Wendt et al.

(10) Patent No.: US 7,316,144 B2
(45) Date of Patent: Jan. 8, 2008

(54) ROLLING MILL CONSISTING OF HORIZONTAL STANDS AND VERTICAL STANDS

(75) Inventors: Stefan Wendt, Hilchenbach (DE); Jochen Münker, Kreuztal (DE)

(73) Assignee: SMS Demag AG, Dusseldorf (DE)

( * ) Notice: Subject to any disclaimer, the term of this patent is extended or adjusted under 35 U.S.C. 154(b) by 0 days.

(21) Appl. No.: 10/575,146

(22) PCT Filed: Oct. 15, 2004

(86) PCT No.: PCT/EP2004/011666

§ 371 (c)(1),
(2), (4) Date: Apr. 7, 2006

(87) PCT Pub. No.: WO2005/046895

PCT Pub. Date: May 26, 2005

(65) Prior Publication Data

US 2007/0033978 A1 Feb. 15, 2007

(30) Foreign Application Priority Data

Nov. 6, 2003 (DE) ..... 103 51 900

(51) Int. Cl.
*B21B 13/12* (2006.01)

(52) U.S. Cl. ..... 72/226; 72/234

(58) Field of Classification Search ..... 72/234, 72/235, 236, 237, 226
See application file for complete search history.

(56) References Cited

U.S. PATENT DOCUMENTS

| | | | | | |
|---|---|---|---|---|---|
| 186,561 | A | * | 1/1877 | Hickman | 72/225 |
| 694,722 | A | * | 3/1902 | Brooker | 72/227 |
| 1,385,644 | A | * | 7/1921 | Roberts | 72/225 |
| 2,089,311 | A | * | 8/1937 | Tolles | 72/235 |
| 4,587,823 | A | * | 5/1986 | Eibe | 72/206 |

FOREIGN PATENT DOCUMENTS

| | | | |
|---|---|---|---|
| EP | 0052467 | | 5/1982 |
| EP | 1167782 | | 1/2002 |
| JP | 55100807 | A * | 8/1980 |
| JP | 55144308 | A * | 11/1980 |
| JP | 55144309 | A * | 11/1980 |

OTHER PUBLICATIONS

Patent Abstract of Japan, JP-55126307, Dec. 1980.
Patent Abstract of Japan, JP-55144309, Jan. 1981.
Search Report.

* cited by examiner

*Primary Examiner*—Dmitry Suhol
(74) *Attorney, Agent, or Firm*—Abelman, Frayne & Schwab

(57) ABSTRACT

In a rolling mill which consists of at least one horizontal stand (1) and at least one vertical stand (2), which are connected with each other, between both stands (1, 2), connection elements (7) are releasably arranged, wherein the connection elements (7) consist of a right flange (14), a left flange (12), and a web (13) arranged therebetween.

3 Claims, 3 Drawing Sheets

ROLLING MILL CONSISTING OF HORIZONTAL STANDS AND VERTICAL STANDS

The invention relates to a rolling mill consisting of at least one horizontal stand and at least one vertical stand which are connected with each other.

During rolling of, e.g., slabs, it is known to provide a vertical stand directly after a horizontal stand in order to reduce the width of a slab. Dependent on a rolling mill, further horizontal and/or vertical stands follow. It is further known to form-and/or forcelockingly connect the horizontal and/or vertical stand. Such a connection serves, on one hand, to minimize vibrations in a rolling mill and, on the other hand, to form a larger base for mounting both stands on a base on which the rolling mill with its horizontal and vertical stands is mounted and secured.

Figure 2:
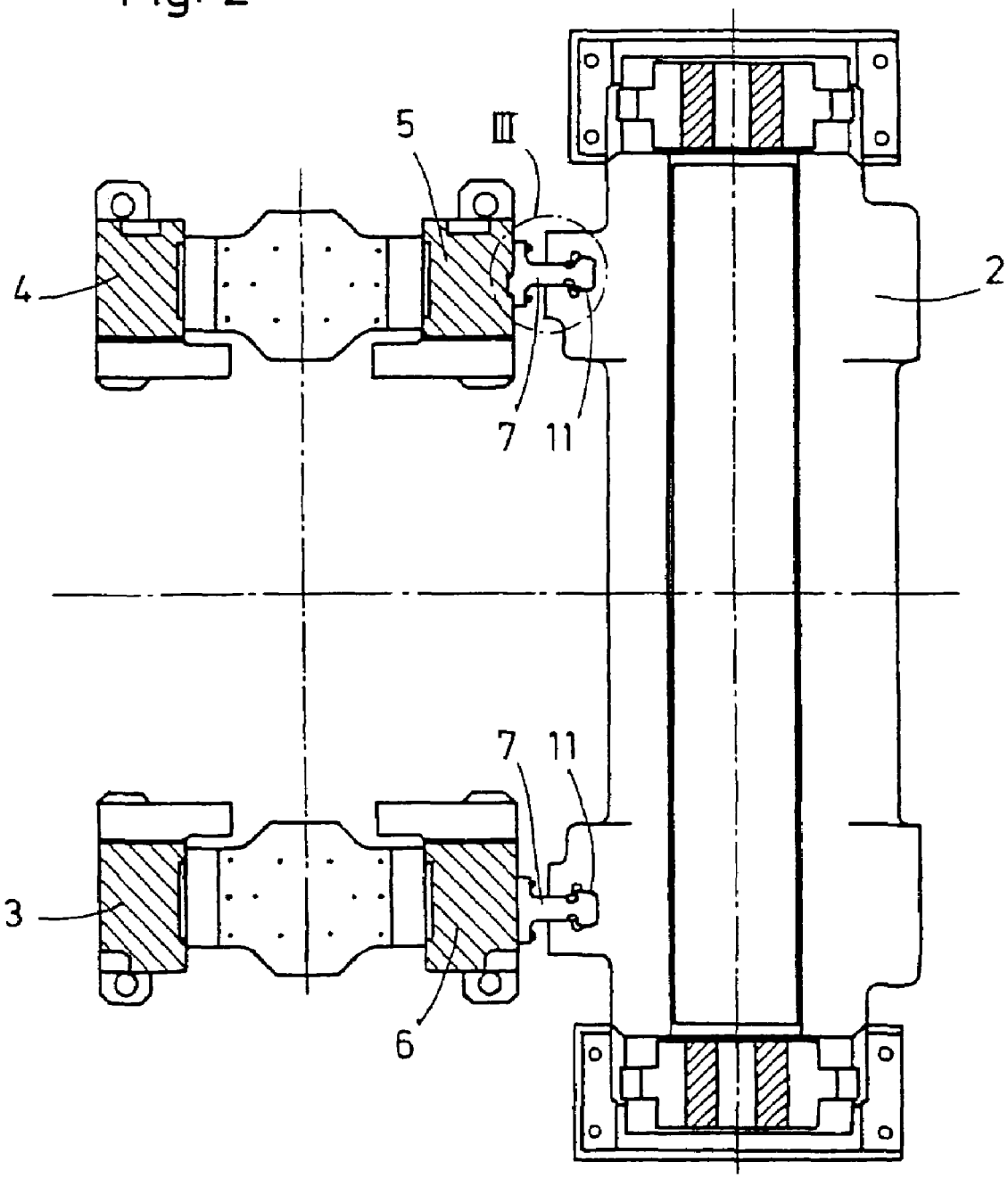
Figure 3:
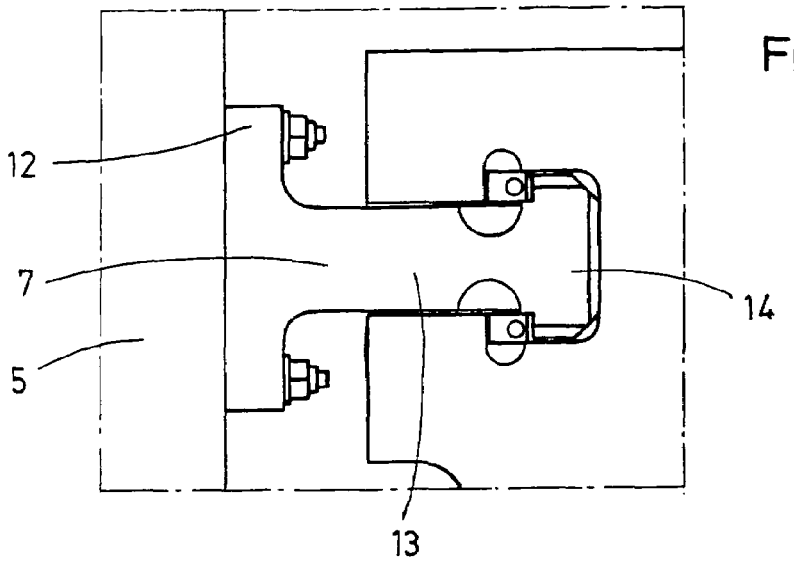

The publication JP 55 144 308 discloses a rolling mill in which in front of and behind a horizontal stand, a vertical stand is, respectively, arranged, and the front and rear vertical stands are connected with the horizontal stand arranged in the middle. JP 55 100 807 discloses connections of vertical stand-horizontal stand-vertical stand, with connection bolts connecting all of the three stands. FIGS. 2 and 3 show connections in which rods with one-side threads extend through common bores in both vertical stands and the horizontal stand, which is arranged therebetween, enabling connection of these three units. According to FIG. 1, the horizontal stand, which is located in the middle, is secured with screws to the vertical stands arranged on the right and the left. Another connection is shown in FIGS. 9 and 10. According to the figures, beams, which are recessed or are provided with clamp rims, provide for connection of the stands.

Also known are connections with which projections, which are formed on vertical stands engage around retaining wedges provided on the horizontal stands. With the circumferential engagement, clearances are formed in which wedges are inserted in order to connect a vertical stand with the horizontal stand. In another embodiment, the projections of the vertical stands form flange plates which are screwed on the horizontal stands.

During rolling of a rolled stock, a vertical stand can be subjected to a large damage when the rolled stock is fed from the horizontal stand to the closed roll gap of the vertical stand.

The horizontal force, with which a rolling stock is fed to the rolls of the vertical stand, can be calculated based on the roll separating force and the rolling torque of the horizontal stand and on the geometry and material characteristics of the rolled stock. The produced maximal horizontal force is designated as a crash load. In order to prevent any damage to the entire rolling mill or to avert its damage, the crash load should be absorbed in the stands of the horizontal and/or vertical rolling mill stands.

Accordingly, an object of the invention is to provide a connection between at least one horizontal rolling mill stand and at least one vertical rolling mill stand and which can absorb such a crash load and is formed so that it requires little space and is releasable.

According to the invention, the object of the invention is achieved by releasably arranging connection elements between both rolling mill stands, wherein the connection elements each consists of a left flange, a right flange, and a web arranged therebetween.

The embodiments of the invention are recited in subclaims.

A connection element formed according to the invention provides a slim and light construction. Therefore, separate connection elements can be mounted or secured between the rolling mill stands without a large expenditure of force. Further, the connection elements require very little space, which makes available a free constructional space for other components, in particular for tubing. With the use of the inventive connection elements, a play-free and stress-free connection of the rolling mill stands is obtained. The design of the connection elements, i.e., their dimensioning is effected based on the knowledge of the greatest, always to be considered, horizontal force, so that the crash load can be absorbed by the rolling mill stands, without the crash load passing in the foundation.

Figure 1:
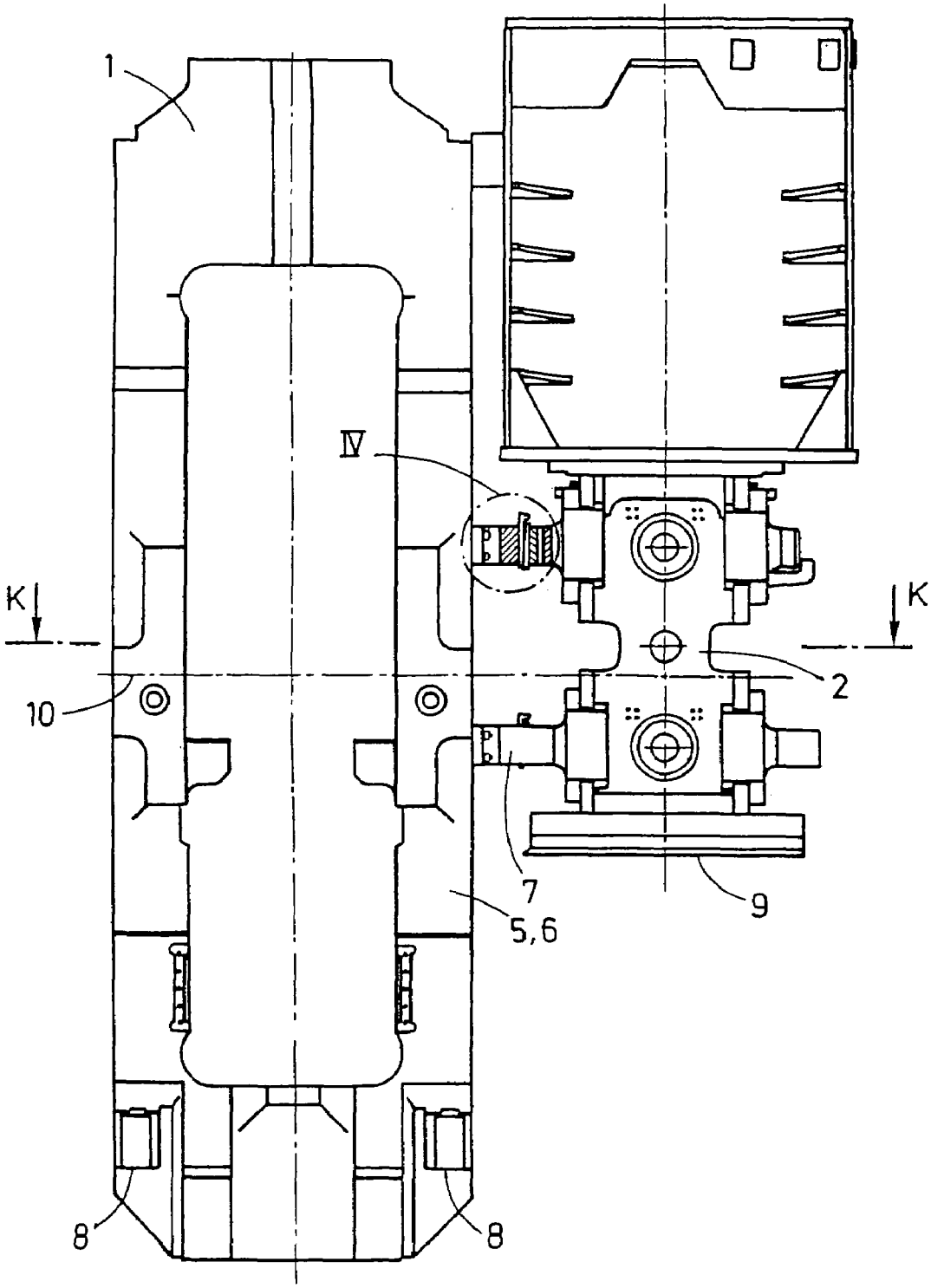
Figure 4:
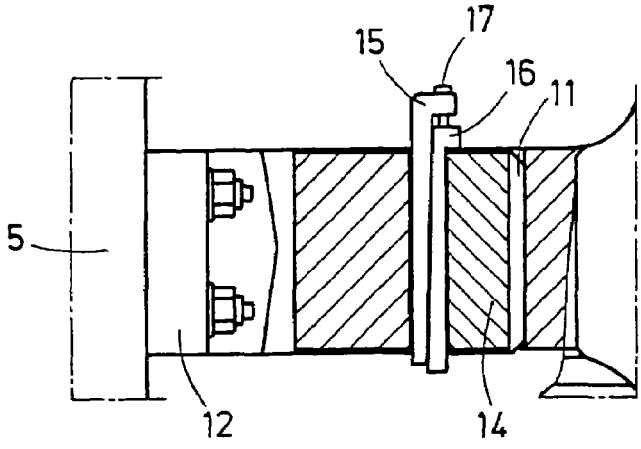
Figure 5:
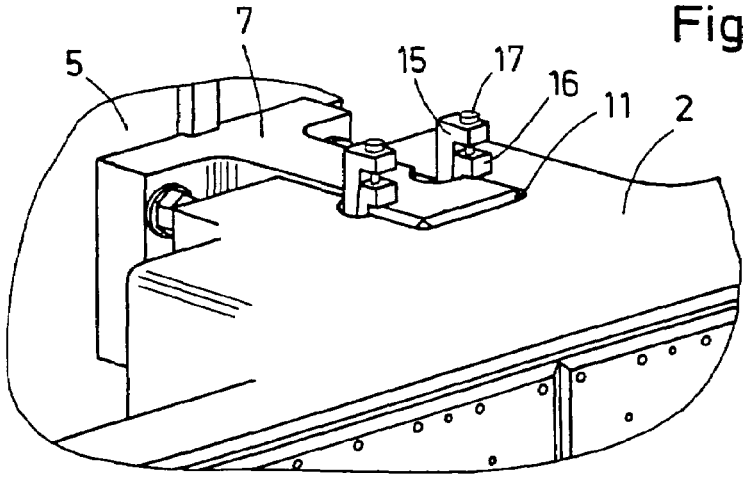

Further details of the invention follow from the claims and the following description in which the embodiment of the invention, which is shown very schematically in the drawings, is explained in details. The drawings show:

FIG. 1 a side view of a horizontal stand and a connected therewith vertical stand;

FIG. 2 a plan cross-sectional view of the connected stands shown in FIG. 1 along line K-K;

FIG. 3 a plan view of the connection element as detail (III);

FIG. 4 a side partially cross-sectional view of the connection element as detail (IV); and FIG. 5 a perspective view of the connection element between two stands.

FIG. 1 shows a horizontal stand 1 and a connected therewith, vertical stand 2. The horizontal stand 1 consists of front 3 and rear 4 rolling stands (FIG. 2) on respective right cross-beams 5, 6 of which, a vertical stand 2 is secured with connection elements 7. The lower flanges 8 of the horizontal rolling stand 1 and the lower flanges 9 of the vertical stand are arranged on and secured to a base (not shown).

The connection elements 7 are provided on the right stand cross-bars 5, 6 of the front and rear rolling stands 3, 4 of the horizontal stand 1 above and below a pitch line 10, respectively. In the embodiment shown in the drawings, the connection elements 7 are screwed with the horizontal stand 1.

FIG. 2 shows the vertical elements 7 which are guided in T-shaped grooves 11 that extend vertically in the vertical stand 2.

As shown in FIG. 3, the connection elements 7 are each formed of a left flange, a web 13, and a right flange 14, with the left flange 12 being secured to the stand cross-bar 5 of the rolling stand 3 with screws.

FIG. 4 shows the same connection as FIG. 3 but in a side, partially cross-sectional view. In order to reduce play between the right flange 14 and the T-shaped groove 11, tangential wedges 15, 16 are used. The total thickness of the wedge pair is increased by longitudinally displacing both tangential wedges 15, 16 relative to each other, whereby a play-free connection of the horizontal stand 1 with the vertical stand 2 is achieved. The position of the tangential wedges 15, 16 is in insured by a threaded connection 17. The arrangement of the tangential wedges 15, 16 in the T-shaped grooves 11 of the vertical stand is shown in perspective in FIG. 5.

The invention claimed is:

1. A rolling mill, comprising at least one horizontal stand (1) and at least one vertical stand (2), which are connected with each other, and connection elements (7) releasably arranged between the at least one horizontal stand (1) and the at least one vertical stand (2), wherein the connection elements (7) consist of a left flange (12), a right flange (14), and a web (13) arranged therebetween, characterized in that one of the left and right flanges (12, 14) is screwed to one of the horizontal and vertical stands (1, 2) and another of the left and right flanges (12, 14) is guided and wedged in a T-shaped groove (11) of another of the horizontal and vertical stands (1, 2).

2. A rolling mill, comprising at least one horizontal stand (1) and at least one vertical stand (2), which are connected with each other; and connection element (7) releasably arranged between the at least one horizontal stand (1) and the at least one vertical stand (2), wherein the connection elements (7) consist of a left flange (12), a right flange (14), and a web (13) arranged therebetween, characterized in that both flanges (12, 14) are guided and wedged in T-shaped grooves (11) formed in the horizontal and vertical stands (1, 2).

3. A rolling mill according to claim 2, characterized in that tangential wedges (15, 16) are used upon wedging of the flanges (12, 14).

* * * * *